US010765227B2

(12) United States Patent
Scudieri

(10) Patent No.: US 10,765,227 B2
(45) Date of Patent: Sep. 8, 2020

(54) MATTRESS

(71) Applicant: ME.RES. S.r.l., Avellino (AV) (IT)

(72) Inventor: Luca Scudieri, Avellino (IT)

(73) Assignee: ME. RES. S.R.L., Avellino (AV) (IT)

( * ) Notice: Subject to any disclaimer, the term of this patent is extended or adjusted under 35 U.S.C. 154(b) by 328 days.

(21) Appl. No.: 15/957,979

(22) Filed: Apr. 20, 2018

(65) Prior Publication Data

US 2018/0303247 A1 Oct. 25, 2018

(30) Foreign Application Priority Data

Apr. 21, 2017 (IT) ..... 102017000044173

(51) Int. Cl.

| | |
|---|---|
| ***A47C 27/15*** | (2006.01) |
| ***A47C 27/22*** | (2006.01) |
| ***A47C 31/10*** | (2006.01) |
| ***A47C 31/00*** | (2006.01) |
| ***A47C 27/12*** | (2006.01) |
| ***A47C 21/04*** | (2006.01) |

(52) U.S. Cl.

CPC ..... *A47C 27/15* (2013.01); *A47C 27/22* (2013.01); *A47C 31/006* (2013.01); *A47C 31/105* (2013.01); *A47C 21/042* (2013.01); *A47C 27/122* (2013.01)

(58) Field of Classification Search

CPC ..... A47C 27/15; A47C 27/148; A47C 27/14; A47C 27/22; A47C 27/12; A47C 27/121; A47C 27/122; A47C 27/00; A47C 27/001; A47C 27/002; A47C 27/005; A47C 27/006; A47C 27/007; A47C 21/00; A47C 21/04; A47C 21/042; A47C 21/044; A47C 31/00; A47C 31/006; A47C 31/105

USPC ... 5/724, 723, 727, 728, 737–740, 691, 690, 5/652, 652.1, 655.9, 953

See application file for complete search history.

(56) References Cited

U.S. PATENT DOCUMENTS

| | | | | |
|---|---|---|---|---|
| 1,088,959 A * | 3/1914 | Benton | ..... | A47C 27/003 5/739 |
| 4,539,723 A * | 9/1985 | Hillsberry | ..... | A47C 27/085 24/72.5 |
| 4,930,170 A * | 6/1990 | Kobayashi | ..... | A47C 17/045 5/12.1 |
| 5,878,455 A * | 3/1999 | Patterson | ..... | A47C 19/02 248/345.1 |

(Continued)

FOREIGN PATENT DOCUMENTS

| | | |
|---|---|---|
| DE | 20309793 U1 | 10/2003 |
| DE | 202011108582 U1 | 2/2012 |

(Continued)

*Primary Examiner* — Robert G Santos

(74) *Attorney, Agent, or Firm* — King & Schickli, PLLC

(57) ABSTRACT

A mattress is described, comprising an ergonomic layer made of foam material and a breathable layer made of three-dimensional polymeric material. The ergonomic layer and the breathable layer are mutually coupled. The breathable layer is individually wrapped in a casing made of a three-dimensional breathable fabric. The combination between the breathable layer and the respective casing, which is also manufactured with a three-dimensional breathable type of material, allows to obtain the maximum breathable characteristics for the mattress.

11 Claims, 1 Drawing Sheet

(56) References Cited

U.S. PATENT DOCUMENTS 6,269,504 B1 * 8/2001 Romano ..... A47C 27/122 5/653
6,701,556 B2 * 3/2004 Romano ..... A47C 27/122 297/452.27
6,708,352 B2 * 3/2004 Salvatini ..... A61G 1/00 5/423
6,708,357 B2 * 3/2004 Gaboury ..... A47C 23/007 5/663
6,735,800 B1 * 5/2004 Salvatini ..... A61G 1/00 5/710
7,191,480 B2 * 3/2007 Romano ..... A47C 27/122 297/180.14
7,191,482 B2 * 3/2007 Romano ..... A47C 27/122 5/713
7,469,432 B2 * 12/2008 Chambers ..... A47C 21/044 5/423
7,469,436 B2 * 12/2008 Meyer ..... A61G 7/05715 5/690
7,480,953 B2 * 1/2009 Romano ..... A47C 27/122 5/714
7,617,555 B2 * 11/2009 Romano ..... A47C 27/122 5/714
7,712,164 B2 * 5/2010 Chambers ..... A47C 21/044 5/423
7,937,791 B2 * 5/2011 Meyer ..... A61G 7/05715 5/690
7,966,680 B2 * 6/2011 Romano ..... A47C 27/122 5/423
8,196,240 B2 * 6/2012 Meyer ..... A61G 7/05715 5/690
8,522,376 B2 * 9/2013 Rohr ..... A47C 21/026 5/411
8,601,620 B2 * 12/2013 Romano ..... A47C 27/122 5/423
9,462,893 B2 * 10/2016 Romano ..... A47C 27/122
9,615,670 B2 * 4/2017 Takaoka ..... B32B 5/18
2001/0054200 A1 * 12/2001 Romano ..... A47C 27/122 5/690
2003/0084511 A1 * 5/2003 Salvatini ..... A61G 7/05715 5/423
2003/0131418 A1 * 7/2003 Gaboury ..... A47C 23/007 5/690
2004/0168255 A1 * 9/2004 Romano ..... A47C 27/148 5/690
2004/0177450 A1 * 9/2004 Salvatini ..... A61G 7/008 5/714
2004/0237203 A1 * 12/2004 Romano ..... A47C 27/20 5/713
2006/0080778 A1 * 4/2006 Chambers ..... A47C 27/082 5/652.2
2006/0168736 A1 * 8/2006 Meyer ..... A61G 7/05784 5/727
2007/0011813 A1 * 1/2007 Rathle ..... A47G 9/10 5/640
2007/0163052 A1 * 7/2007 Romano ..... A47C 27/144 5/713
2007/0261548 A1 11/2007 Vrzalik et al.
2007/0271705 A1 * 11/2007 Woolfson ..... A47C 27/001 5/655.9
2009/0044338 A1 * 2/2009 Rock ..... A47C 27/007 5/500
2009/0106907 A1 * 4/2009 Chambers ..... A47C 27/082 5/714
2009/0119846 A1 * 5/2009 Meyer ..... A61G 7/05715 5/709
2009/0133194 A1 * 5/2009 Romano ..... A47C 27/20 5/714
2010/0077552 A1 * 4/2010 Malikhin ..... A47C 27/04 5/691
2010/0088818 A1 * 4/2010 Rock ..... D04B 1/02 5/483
2010/0095461 A1 * 4/2010 Romano ..... A47C 27/122 5/710
2011/0047710 A1 * 3/2011 Beard ..... A47C 31/10 5/724
2011/0209289 A1 * 9/2011 Meyer ..... A61G 7/05784 5/699
2011/0289685 A1 * 12/2011 Romano ..... A47C 27/15 5/423
2011/0314607 A1 * 12/2011 Woolfson ..... B32B 5/245 5/636
2013/0185868 A1 * 7/2013 Rohr ..... A47C 21/026 5/498
2014/0096325 A1 * 4/2014 Giannopoulos ..... A47C 27/001 5/691
2014/0115790 A1 * 5/2014 Romano ..... A47C 27/122 5/652.2
2016/0174725 A1 * 6/2016 Takaoka ..... B32B 5/06 5/652.1
2018/0303247 A1 * 10/2018 Scudieri ..... A47C 31/006
2019/0191898 A1 * 6/2019 Scudieri ..... A47G 9/10

FOREIGN PATENT DOCUMENTS

EP 2281485 A1 2/2011
WO WO2005046988 A1 5/2005
WO WO2007003348 A1 1/2007

* cited by examiner

MATTRESS

TECHNICAL FIELD

The present invention refers in general to a mattress. In particular, the present invention refers to a mattress that can be used in a hospital environment, or in other sectors such as civil, naval, automotive, aeronautic or railway services.

Mattresses that are typically used for people who are immobilised, in particular for people that must remain in bed for long periods of time, typically during a stay in hospital or at home, have been known for a long time.

BACKGROUND

These mattresses have orthopaedic characteristics which can be divided into two categories: biomechanical characteristics and microclimatic characteristics.

The biomechanical characteristics relate to the elasticity of the mattress, its tensile strength and its resistance to pressure. Said characteristics serve as the basis (to be completed with further criteria deriving from combined analysis) for defining the performance of the mattress, when subjected to pressure by people with different weights and body sizes.

The microclimatic characteristics typically relate to resistance to humidity and thermal capacity, that contribute to the development of a given contact temperature and humidity between a mattress and a person lying thereon.

In addition to having the orthopaedic characteristics mentioned above, the known mattresses must also be fireproof, hypoallergenic, anti-decubitus (they must prevent and cure bed sores), easy to wash, at least at 60° C. and highly breathable, particularly in the contact area with the user or the patient.

There are currently several types of known mattresses, also known as sanitary mattresses, that adopt different technical solutions.

One of the more known solutions is the memory foam mattress, namely manufactured with a viscoelastic polyurethane foam which deforms with the weight and heat of the human body. These mattresses memorise the shape of the body and as a consequence deform. When the weight is removed, the mattress quickly regains its original shape.

An alternative to the memory foam mattress is the latex mattress, made with natural latex processed in order to provide a foam material to which elasticity and strength are added, by means of a vulcanisation process.

Other types of mattresses also exist, such as, for example, the water-foam mattress (also known as water foamed mattress, made through a polyurethane foam treatment process), the bagged spring mattress, the three-dimensional polymer (or 3D polymer) mattress, normally made of polyester polymer, or the mattress known as anti-decubitus with forced air ventilation. This latter mattress is normally entirely protected by a breathable three-dimensional cover.

SUMMARY

One problem of known mattresses lies in the fact that each of them, brings a series of advantages relative to some of the characteristics mentioned above, but not to all the same characteristics. For example, the memory foam mattress has optimal orthopaedic and ergonomic properties, but it is not very breathable and is difficult to wash. The latex mattress is ergonomic and easy to wash, but it is not orthopaedic, breathable or anti-decubitus.

Another problem with known mattresses resides in the fact that their correct shape is not very long lasting.

Further mattresses of a known type are disclosed, for example, in documents WO 2005/046988 A1, EP 2281485 A1 and DE 202011108582 U1. The mattress disclosed in document WO 2005/046988 A1 is provided with a breathable layer, applied directly on the top surface of a layer made of foam material. This limits the breathable characteristics of the breathable layer, apart from generating coupling problems between different materials, above all in terms of coefficient of elasticity, that make up the two layers.

The mattress disclosed in document EP 2281485 A1 requires the presence of an outer frame that extends along the entire peripheral development of the layers of the mattress itself, by permanently fixing a polyurethane layer to a support layer, made with a three-dimensional fabric. Therefore, also in this case the outer frame limits the breathable characteristics of the mattress.

The mattress disclosed in document DE 202011108582 U1 provides for the presence of a frame made of foam material, provided with ventilation holes. The breathable characteristics of the mattress, therefore, must be necessarily obtained through specific and costly processes which must be carried out on the mattress in order to obtain the ventilation holes.

The object of the present invention is therefore to obtain a mattress that combines all the advantages of the known types of mattresses, in particular a mattress that is fireproof, comfortable, ergonomic, orthopaedic, hypoallergenic, breathable, anti-decubitus, easy to wash, easy to handle, durable and antibacterial.

Another object of the present invention is that of obtaining a mattress that maintains its correct shape for a long period of time.

These and other objects, which will be clear to the person skilled in the art, are obtained by a mattress made according to the technical teachings of the annexed claims.

Advantageously, the mattress according to the present invention comprises an ergonomic layer made of foam material and a breathable layer made of a three-dimensional polymeric material. These two layers are mutually coupled. The breathable layer is individually wrapped, namely independent of the ergonomic layer, in a casing manufactured with a breathable three-dimensional fabric. This allows the maximum breathable characteristics to be obtained.

According to a preferred embodiment of the mattress, it also comprises a base layer made of polyurethane foam coupled to the ergonomic layer and to the breathable layer.

BRIEF DESCRIPTION OF DRAWINGS

Further characteristics and advantages of the present invention will become clear from the description of a preferred but not exclusive embodiment of the mattress, shown by way of a non-limitative example in the annexed drawings, wherein.

Figure 1:
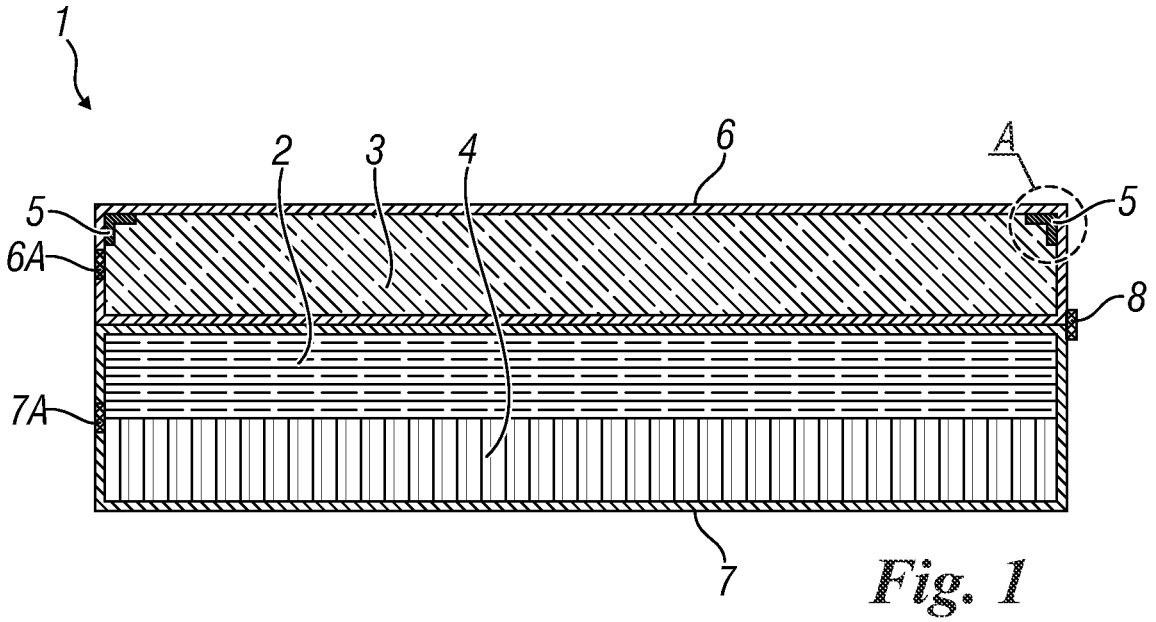
FIG. 1 is a schematic sectional view of the mattress according to the present invention.

With reference to the aforementioned figures, a mattress is shown, indicated as a whole with the reference numeral 1.

DETAILED DESCRIPTION OF THE INVENTION

The mattress 1 comprises an ergonomic layer 2, made of foam material, and a breathable layer 3, made of a three-dimensional polymeric material. The ergonomic layer 2 and the breathable layer 3 are mutually coupled to one another. The ergonomic layer 2 and the breathable layer 3 can advantageously be separated from one another.

Preferably, the foam material with which the ergonomic layer 2 is manufactured is a shape memory type of material. This material can be a polyurethane memory foam, better known as memory foam. Alternatively, it is possible that said memory foam is a worked and vulcanized latex foam.

It is also possible that the foam material is not of the shape memory type. In this case, it is preferable that this material is obtained using a low density polyurethane foam, i.e. having a suitable density, ranging between 15 and 30 kg/m$^3$, more preferably ranging between 20 and 25 kg/m$^3$.

According to the preferred embodiment, the three-dimensional polymeric material with which the breathable layer 3 is manufactured is made with polyester polymer. More precisely, said three-dimensional polymeric material comprises springs made with a three-dimensional polymeric material, i.e. with a polyester polymer.

The coupling of the ergonomic layer 2 made of foam material and of the breathable layer 3 made of three-dimensional polymeric material has a synergic technical effect, which goes beyond the simple summing up of the advantages achieved by said layers when taken individually. Actually, as both the ergonomic layer 2 and the breathable layer 3 are used together, the foam material of the ergonomic layer 2 receives the weight and adapts to the body pressure, leaving the three-dimensional polymer of the breathable layer 3 sufficiently slightly compressed to maintain its breathability. This effect is also obtained even when the breathable layer 3 made of three-dimensional polymer material is arranged on top of the memory foam ergonomic layer 2.

It is decisively more advantageous to have the breathable layer 3 arranged on top of the ergonomic layer 2 (FIG. 1), so that the body lying on said breathable layer 3, thus benefiting the microclimatic characteristics that develop in the contact area between the mattress 1 and the body.

Typically, the memory foam material has a density ranging between 50 kg/m$^3$ and 70 kg/m$^3$, preferably substantially equal to 60 kg/m$^3$, whereas the three-dimensional polymeric material has a density ranging between 20 kg/m$^3$ and 40 kg/m$^3$, preferably substantially equal to 30 kg/m$^3$. Obviously other density values can be provided for these materials.

It should be noted that the three-dimensional polymeric material could have a pre-formed surface so as to be adapted, from an anatomical point of view, to a predetermined pathology.

According to the preferred embodiment, the mattress 1 also comprises a base layer 4 made of polyurethane foam, that is coupled to the ergonomic layer 2 and to the breathable layer 3. Said base layer 4 allows the mattress 1 to maintain its correct shape for long periods of time in comparison to known types of mattresses.

As can be seen in FIG. 1, the base layer 4 is directly coupled to the ergonomic layer 2, which in turn is coupled to the breathable layer 3. Preferably, the base layer 4 and the ergonomic layer 2 are directly coupled by means of glue.

Each of these layers comprises a respective sheet of material.

Figure 2:
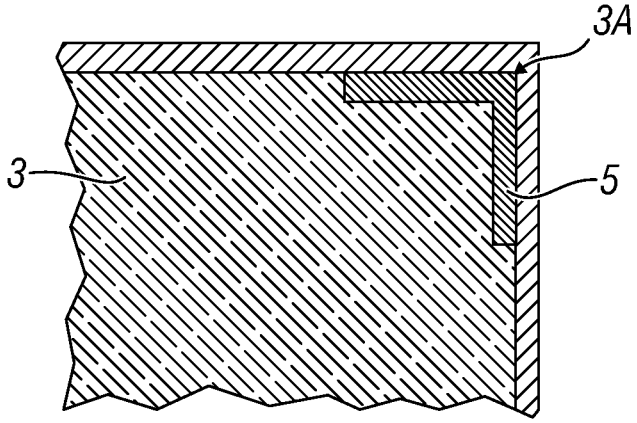
FIG. 2 is an enlarged view of a detail of FIG. 1, indicated with the letter A.

In order to further maintain the correct shape of the mattress 1, it is preferable that the breathable layer 3 is provided with a shape maintaining element 5 arranged along at least a peripheral portion of an upper corner 3A of said breathable layer 3 (FIG. 2). Even more preferably, the shape maintaining element 5 is arranged along the entire upper corner 3A of the breathable layer 3, i.e. along its entire circumference.

In order to maintain the shape of the mattress 1 in an optimal manner, a first shape maintaining element 5 should be provided, arranged along the entire periphery of the upper corner 3A of the breathable layer 3, and a second shape maintaining element (not shown in the figures), arranged along the entire periphery of the lower corner of the breathable layer 3.

In the illustrated embodiment, the shape maintaining element 5 comprises a corner with resin coated wadding. Said shape maintaining element 5 is made integral with the three-dimensional polymer, preferably through heat-sealing, after the three-dimensional polymer layer is made.

Preferably, at least one between the base layer 4 and the ergonomic layer 2 is wrapped in a casing 7 manufactured with a three-dimensional fabric 7.

According to the invention, as shown in particular in FIG. 1, the breathable layer 3 is individually wrapped in a casing 6 manufactured with a three-dimensional breathable fabric. The combination between the breathable layer 3 and the respective casing 6, which is also manufactured with a three-dimensional breathable fabric, allows the maximum breathable characteristics to be obtained for the mattress 1.

The breathable fabric of the casing 6 is preferably formed with 100% flame retardant (FR) polyester.

The base layer 4 and the ergonomic layer 2 are preferably wrapped together in a casing 7 manufactured with a waterproof fabric. The greatest advantage is attained with a casing 7 made of waterproof fabric which is also a three-dimensional fabric. In the preferred embodiment, the waterproof casing 7 is manufactured with an orthogonal fabric.

Each of the casings 6 and 7 is provided with respective closing means 6A and 7A, for example, a zip arranged on a lateral surface of the casing 6 or 7, when wrapped around the breathable layer 3 or the base layer 4 and the ergonomic layer 2, and arranged parallel to the upper or lower surface of the respective layer.

Advantageously, the mattress 1 also comprises coupling means 8 for mutually coupling the breathable casing 6 (that wraps the breathable layer 3) and the waterproof casing 7 (that wraps the base layer 4 and the ergonomic layer 2). Preferably, said coupling means 8 include a zip, a first half 8A of which is arranged along a lower edge of the breathable casing 6, the second half being arranged on an upper edge of the waterproof casing 7, placed at the aforementioned lower edge of the breathable casing 6. The embodiment illustrated in the figures provides for the zip to be arranged along a single side of the casings 6, 7 (i.e. the zip is not arranged at a corner of the casings) in order to be straight. It is however preferable that the zip 8 is provided on the entire periphery of the corners involved, i.e. the lower corner of the breathable casing 6 and the upper corner of the waterproof casing 7.

The mattress 1 has a standard size for a mattress, for example, 80×200×13 cm for a single size mattress, or 160×200×13 cm for a double size mattress. The ergonomic layer 2, the breathable layer 3 and the base layer 4 have an overall thickness ranging between 13 cm and 20 cm.

The process for manufacturing the mattress 1 according to the present invention is as follows.

Firstly, a sheet made of memory foam material, a sheet made of three-dimensional polymeric material and, if envisaged, a sheet made of polyurethane foam are manufactured. The sheet made of polyurethane foam is then preferably glued onto the memory foam material sheet.

The sheet made of polyurethane foam and the sheet made of memory foam material are then both wrapped together in the casing 7 made of waterproof and three-dimensional fabric, whereas the sheet made of three-dimensional polymeric material is wrapped in the casing 6 made of three-dimensional breathable fabric.

Each of the aforementioned casings 6 and 7 are then closed by means of respective closing means 6A and 7A, i.e. the zips. The casings 6 and 7 are then coupled by means of coupling means 8, i.e. the zip, the halves of which are arranged respectively at a lower edge of the casing 6 made of three-dimensional breathable fabric and at an upper edge of the casing 7 made of three-dimensional waterproof fabric.

The invention claimed is:

1. A mattress comprising:

an ergonomic layer made of foam material; and a breathable layer made of three-dimensional polymeric material, wherein said ergonomic layer and said breathable layer are mutually coupled to one another, and wherein the breathable layer is individually wrapped in a casing made of a three-dimensional breathable fabric.

2. The mattress according to claim 1, wherein the foam material with which the ergonomic layer is manufactured is a memory foam material.

3. The mattress according to claim 2, wherein the memory foam material is a polyurethane foam.

4. The mattress according to claim 2, wherein the memory foam material is a latex foam.

5. The mattress according to claim 1, wherein the foam material with which the ergonomic layer is manufactured is a polyurethane having a density ranging between 15 and 30 $kg/m^3$.

6. The mattress according to claim 1, wherein the three-dimensional polymeric material with which the breathable layer is manufactured is a three-dimensional polyester.

7. The mattress according to claim 1, wherein it also comprises a base layer made of polyurethane foam, coupled to the ergonomic layer and to the breathable layer.

8. The mattress according to claim 1, wherein the breathable layer is arranged on top of the ergonomic layer.

9. The mattress according to claim 1, wherein the breathable layer is provided with a shape maintaining element arranged along at least a peripheral portion of an upper edge of said breathable layer.

10. The mattress according to claim 7, wherein at least one between the base layer and the ergonomic layer is wrapped in a casing manufactured with a three-dimensional fabric.

11. The mattress according to claim 7, wherein the base layer and the ergonomic layer are wrapped together in a casing manufactured with a waterproof fabric.

* * * * *